United States Patent [19]

Thevenet

[11] Patent Number: 4,885,039

[45] Date of Patent: Dec. 5, 1989

[54] METHOD OF CONNECTING A METAL END FITTING TO AN INSULATOR COMPONENT HAVING AN ELASTOMER END FIN AND AN ORGANIC ELECTRICAL INSULATOR OBTAINED BY THE METHOD

[75] Inventor: Guy Thevenet, Le Bourg, France

[73] Assignee: Ceraver, S.A., Paris, France

[21] Appl. No.: 136,523

[22] Filed: Dec. 22, 1987

Related U.S. Application Data

[63] Continuation of Ser. No. 588,051, Mar. 9, 1984, abandoned.

[30] Foreign Application Priority Data

Mar. 18, 1983 [FR] France ..... 83 04450

[51] Int. Cl.[4] ..... H01B 17/20; H01B 17/02

[52] U.S. Cl. ..... 156/294; 156/338; 174/140 S; 174/179

[58] Field of Search ..... 156/294, 293, 309.6, 156/338; 174/140 S, 179, 180, 186, 210, 211

[56] References Cited

U.S. PATENT DOCUMENTS

| | | | |
|---|---|---|---|
| 4,267,403 | 5/1981 | Pargamin | 174/179 X |
| 4,331,833 | 5/1982 | Pargamin et al. | 156/294 X |
| 4,355,200 | 10/1982 | Wheeler et al. | 174/140 S |

FOREIGN PATENT DOCUMENTS

| | | |
|---|---|---|
| 0412448 | 4/1925 | Fed. Rep. of Germany . |
| 0413266 | 5/1925 | Fed. Rep. of Germany . |
| 2855211 | 7/1980 | Fed. Rep. of Germany . |
| 2360968 | 3/1978 | France . |
| 2419571 | 11/1979 | France . |
| 1126411 | 9/1968 | United Kingdom . |
| 1233310 | 5/1971 | United Kingdom . |
| 2041444 | 9/1980 | United Kingdom . |
| 2053583 | 2/1981 | United Kingdom . |

*Primary Examiner*—Raymond Hoch
*Attorney, Agent, or Firm*—Kenyon & Kenyon

[57] ABSTRACT

A metal end fitting (13) is hermetically sealed to an end fin (4) of an insulator component (1) which includes an insulating rod (2) surrounded by fins (4) of vulcanized elastomer by coating at least one layer of rubber/metal gluing agent on the bottom portion (12) of the metal end fitting (13), then disposing an intermediate washer (10) of raw elastomer between the metal end fitting (13) and the end fin (4), fixing the end fitting (13) to the rod (2) in such a manner that the intermediate washer (10) ring is cmopressed between the end fin (4) and the bottom portion (12) of the end fitting (13), and then vulcanizing the washer (10).

4 Claims, 1 Drawing Sheet

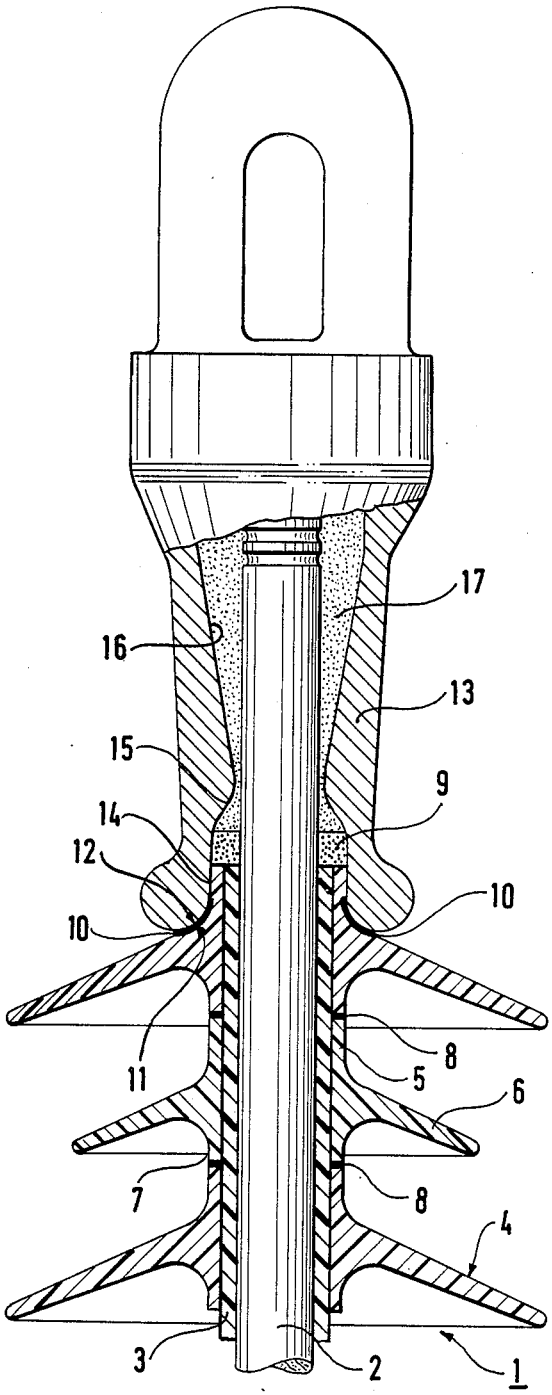
17
16
13
15
9
14
12
10
10
11
8
5
6
7
8
4
3
2
1

METHOD OF CONNECTING A METAL END FITTING TO AN INSULATOR COMPONENT HAVING AN ELASTOMER END FIN AND AN ORGANIC ELECTRICAL INSULATOR OBTAINED BY THE METHOD

This application is a continuation of application Ser. No. 588,051, filed 3/9/84, abandoned.

The present invention relates to a method of connecting a metal end fitting to an end fin of an insulator component comprising an insulating rod surrounded by fins of vulcanized elastomer. The invention also relates to an organic electrical insulator obtained by the method.

BACKGROUND OF THE INVENTION

It is known to dispose a layer of polychloroprene glue between the metal end fitting and the last fin. This layer of glue provides sealing between the end fitting and the fin.

German patent publication DE-A-2,855,211 describes a seal made of silicone grease.

However, it is observed with both these arrangements that the seal deteriorates progressively over time: further, in particular due to traction forces, the seal may be partially damaged.

SUMMARY OF THE INVENTION

The method of connection in accordance with the invention enabling such drawings to be avoided is characterized in that at least one layer of rubber-to-metal gluing agent is coated on the bottom portion of the metal end fitting, then an intermediate washer of raw elastomer is disposed between the end fitting and the end fin, the end fitting is fixed to the rod in such a manner that the intermediate washer is compressed between the end fin and the bottom portion of the end fitting, and then the washer is vulcanized.

After vulcanization, the elastomer seal retains its sealing characteristics over time, and expands when traction forces are applied to the insulator component, without breaking the seal.

BRIEF DESCRIPTION OF THE DRAWING

An implementation of the invention is described in greater detail with reference to the sole FIGURE of the accompanying drawing which shows an insulator component having the connection between its end fin and its end fitting made in accordance with the invention. The insulator component shown is the top end of an organic electrical insulator.

MORE DETAILED DESCRIPTION

The insulator component 1 comprises a composite glass fiber insulating rod 2 surrounded by a sheath 3 of elastomer in the raw state.

Vulcanized elastomer fins 4 are threaded over the rod 2 in its sheath 3. Each fin 4 includes an upper sleeve 5, a lower sleeve 7, and a skirt portion 6 making an obtuse angle with the upper sleeve 5 and an acute angle with the lower sleeve 7.

As the fins 4 are being threaded onto the sheathed rod, an intermediate washer 8 of raw electromer is disposed between the lower sleeve 7 of each fin and the upper sleeve 5 of the next fin 4.

An insulator of this type is described, for example, in British published patent application No. 2,053,583.

A foam washer 9 is then placed around the rod 2 on the top edge of the upper sleeve 5 of the top fin 4 and also on the top edge of the sheath 3.

An intermediate washer 10 of raw elastomer is placed on the transition region 11 between the upper sleeve 5 and the peripheral portion 6 of the top fin, after roughening said region 11.

The bottom part 12 of a metal end fitting 13 is placed on the washer 10, after said bottom part 12 has been coated with a rubber-to-metal gluing agent. Said gluing agent enables the elastomer to be glued to the metal during subsequent vulcanization. The washer 10 makes perfect contact with the portion 12, of the end fitting 13, even if the surface of the end fitting has many irregularities.

The end fitting 13 has an internal cylindrical wall 14 which is contiguous with the bottom part 12 and which tightly surrounds the upper sleeve 5 of the top fin 4 together with the foam washer 9.

Thereafter the end fitting has a first conical surface 15 which runs from the cylindrical wall 14 to come closer to the rod 2, followed by a second conical surface 16 which goes away from the rod 2. While the end fitting 13 is pressed down hard on the washer 10, the cavity between the surfaces 15 and 16 and the rod 2 is filled with polymerizable resin.

After the resin has been polymerized, the rod 2 is locked in a bi-conical volume 17 in such a manner that traction forces applied to the end fitting 13 are transmitted to the rod 2.

The insulator component 1 and its end fitting 13 are then raised to vulcanizing temperature. All the elastomer which was in the raw state is vulcanized, and the washer 10 becomes a hermetic seal between the end fitting 13 and the top fin 4. When the insulator component is subjected to traction, the sealing washer 10 stretches without breaking the seal.

The raw elastomer used is preferably EPDM having a vulcanization temperature of about 140° C. to 160° C.

I claim:

1. A method for connecting a metal end fitting having a socket with an open end to an exposed end of an insulating rod surrounded by a plurality of axially disposed fins of vulcanized elasomer, the plurality of fins terminating in an end fin disposed next to the exposed end of the insulating rod, the method comprising coating at least one layer of a rubber-to-metal gluing agent on an annular portion of the socket of the metal end fitting adjacent to the open end of the socket;

disposing a washer of raw elastomer around the exposed end of the insulation rod in contact with the end fin;

inserting the exposed end of the insulating rod into the open end of the socket of the end fitting so that the washer is contacted by the coated annular portion of the end fitting and is compressed between the end fitting and the end fin;

fixing the end fitting to the end of the insulation rod so as to maintain the washer compressed between the end fitting and the end fin; and then vulcanizing the washer.

2. A method according to claim 1, the method further comprising:

disposing an intermediate washer formed from a thin sheet of raw elastomeric material between each pair of axially adjacent fins and vulcanizing said intermediate washers between the adjacent fins concurrently with vulcanizing the washer between the end fin and the coated annular portion of the end fitting.

3. A method according to claim 2, the method further comprising:

disposing a sheath of raw elastomer between the rod and the fins and vulcanizing the sheath concurrently with the intermediate washers and the washer between the end fin and the coated annular portion of the end fitting.

4. An organic electrical insulator comprising:

an elongated central insulating rod;

a plurality of vulcanized elastomer fins disposed in axially aligned relation surrounding the insulating rod and terminating with an end fin disposed adjacent to one end of the insulating rod;

a metal end cap having a socket fixed onto one end of the insulating rod, the socket of the metal and cap having an end surface opposed to an end surface of said end fin on the insulating rod;

a coating of at least one layer of a metal-to-rubber gluing agent on an annular portion of said end surface of the metal fitting; and an elastomeric washer formed of raw elastomeric material and vulcanized to the coated end surface of the metal end fitting and to the end surface of the adjacent end fin, said washer being compressed between the end cap and the end fin.

* * * * *

UNITED STATES PATENT AND TRADEMARK OFFICE

CERTIFICATE OF CORRECTION

PATENT NO. : 4,885,039

DATED : December 5, 1989

INVENTOR(S) : Thevenet

It is certified that error appears in the above-identified patent and that said Letters Patent is hereby corrected as shown below:

Abstract, line 10: Change "cmopressed" to --compressed--.

Column 1, line 30: Change "drawings" to --drawbacks--.

Signed and Sealed this

Fourth Day of December, 1990

*Attest:*

HARRY F. MANBECK, JR.

*Attesting Officer*

*Commissioner of Patents and Trademarks*